US010087741B2

(12) United States Patent
Chen et al.

(10) Patent No.: US 10,087,741 B2
(45) Date of Patent: Oct. 2, 2018

(54) PREDICTING PUMP PERFORMANCE IN DOWNHOLE TOOLS

(71) Applicant: Schlumberger Technology Corporation, Sugar Land, TX (US)

(72) Inventors: Lei Chen, Sugar Land, TX (US); Kent David Harms, Richmond, TX (US); Kai Hsu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 395 days.

(21) Appl. No.: 14/755,198

(22) Filed: Jun. 30, 2015

(65) Prior Publication Data

US 2017/0002644 A1 Jan. 5, 2017

(51) Int. Cl.

*H01L 21/00* (2006.01)
*E21B 47/00* (2012.01)
*E21B 49/08* (2006.01)

(52) U.S. Cl.

CPC ..... *E21B 47/0007* (2013.01); *E21B 49/08* (2013.01)

(58) Field of Classification Search

CPC ..... E21B 47/0007; E21B 49/08
See application file for complete search history.

(56) References Cited

U.S. PATENT DOCUMENTS 7,594,541 B2 * 9/2009 Ciglenec ..... E21B 49/10 166/105
8,813,554 B2 * 8/2014 Fujisawa ..... E21B 49/081 73/152.27
8,967,253 B2 * 3/2015 Ciglenec ..... E21B 49/10 166/250.02
9,109,434 B2 * 8/2015 Indo ..... E21B 47/102
9,222,352 B2 * 12/2015 Hoefel ..... E21B 49/088
9,334,724 B2 * 5/2016 Hsu ..... E21B 47/06
9,347,314 B2 * 5/2016 Indo ..... E21B 49/088
9,453,408 B2 * 9/2016 Indo ..... E21B 47/102
9,557,312 B2 * 1/2017 Zuo ..... G01N 33/2841
9,803,467 B2 * 10/2017 Tang ..... E21B 47/06
(Continued)

FOREIGN PATENT DOCUMENTS

CA 2767538 A1 * 6/2013 ..... E21B 47/0007

OTHER PUBLICATIONS

International Search Report and Written Opinion issued in corresponding International application PCT/US2016/038283 dated Sep. 12, 2016. 15 pages.

*Primary Examiner* — Laura Menz

(57) ABSTRACT

Systems, methods, and devices for predicting pump performance in a downhole tool are provided. A pump performance predictor may receive inputs and generate outputs that predict the performance of a pump of a pumpout module of a downhole tool. The pump performance predictor may calculate and output a set of first predictions that include, for example, the minimum alternator voltage of a power module used to power the electronics of the pumpout module, the maximum pump flowrate, the pumpout performance, and the achievable formation mobility. The pump performance predictor may also calculate and output a set of second predictions that may include, for example, a pump volume efficiency, a pressure profile in a flowline, the number of strokes to fill a sampling bottle, and the time to fill the sampling bottle.

22 Claims, 13 Drawing Sheets

(56) References Cited

U.S. PATENT DOCUMENTS 9,957,783 B2* 5/2018 Gonzales ..... E21B 43/121
2007/0020110 A1 1/2007 Mills
2011/0088484 A1 4/2011 Camilleri
2011/0266056 A1 11/2011 Pop et al.
2012/0304757 A1* 12/2012 Fujisawa ..... E21B 49/081 73/152.27
2013/0133881 A1 5/2013 Boyles et al.
2014/0131037 A1* 5/2014 Hsu ..... E21B 47/0007 166/264
2014/0360257 A1* 12/2014 Indo ..... E21B 47/102 73/152.28
2014/0360259 A1* 12/2014 Indo ..... E21B 49/088 73/152.55
2014/0379300 A1 12/2014 Devine et al.
2015/0013968 A1* 1/2015 Hsu ..... E21B 47/06 166/250.01
2015/0226059 A1* 8/2015 Zuo ..... G01N 33/2841 73/152.18
2015/0308261 A1* 10/2015 Zuo ..... E21B 49/08 166/250.01
2015/0308264 A1* 10/2015 Zuo ..... E21B 49/088 702/6
2015/0354353 A1* 12/2015 Indo ..... E21B 47/102 702/8
2016/0053607 A1* 2/2016 Pop ..... F04B 47/00 166/250.01
2016/0168985 A1* 6/2016 Betancourt-Pocaterra ..... E21B 49/005 73/152.04
2016/0177707 A1* 6/2016 Hsu ..... G01N 11/16 702/12
2016/0252454 A1* 9/2016 Zuo ..... G01N 11/00 250/254
2016/0265341 A1* 9/2016 Subervie ..... F04D 15/0066
2017/0002644 A1* 1/2017 Chen ..... E21B 47/0007
2017/0089192 A1* 3/2017 Rendusara ..... E21B 47/0007
2017/0101863 A1* 4/2017 Coste ..... E21B 47/0007
2017/0122094 A1* 5/2017 Chugunov ..... E21B 47/0007
2017/0138921 A1* 5/2017 Zuo ..... G01N 33/2841
2017/0175516 A1* 6/2017 Eslinger ..... E21B 47/0007

* cited by examiner

PREDICTING PUMP PERFORMANCE IN DOWNHOLE TOOLS

BACKGROUND

This disclosure relates to downhole tools and, more particular, to predicting the pump power and efficiency of a pump in a downhole tool.

Downhole drilling operations may include the use of downhole tools used for measuring, logging, or sampling while drilling. Some downhole tools may include a pump to obtain samples of formation fluids for determination of fluid properties using downhole fluid analysis (DFA). A downhole tool may be used in a variety of downhole operation conditions and formation fluid compositions. Estimating the performance of a pump of a downhole tool may be difficult. Inaccurate or time-consuming estimates may affect the operation to obtain of a desired volume of formation fluid within a certain amount of time and without contamination.

SUMMARY

A summary of certain embodiments disclosed herein is set forth below. It should be understood that these embodiments and associated aspects are presented merely to provide the reader with a brief summary of these certain embodiments and that the associated aspects are not intended to limit the scope of this disclosure. Indeed, this disclosure may encompass a variety of embodiments and aspects that may not be set forth below.

Embodiments of this disclosure relate to various systems, methods, and devices for determining pump performance in downhole tools, such as for planning an operation (e.g., a sampling operation) for a subterranean formation. In some embodiments, a method is provided that includes obtaining a plurality of operating conditions associated with a pump of a downhole tool configured to be operated in a wellbore of a well. The pump may be coupled to a flowline and a sample bottle for obtaining a sample of a formation fluid. The method further includes determining, from the plurality of operating conditions, first predictions associated with performance of the pump. The first predictions may include at least one of a minimum alternator voltage, a maximum pump flow rate, a pumpout performance estimate, and an achievable formation mobility. The method also includes obtaining a type of the formation fluid, one or more wellbore properties associated with the wellbore, and one or more formation properties associated with the formation and determining based at least in part on the formation fluid type, the one or more wellbore properties, the one or more formation properties, and a pump flow rate at a selected achievable formation mobility, second predictions associated with performance of the pump. The second predictions may include at least one of a volume efficiency of the pump, a minimum pressure in the flowline, a number of strokes of the pump to fill the sampling bottle, and an amount of time to fill the sampling bottle. The method further includes planning the operation based at least in part on the first predictions and the second predictions.

In some embodiments, non-transitory machine-readable medium storing computer-executable instructions that, when executed, causes a processor to perform the following: obtaining a plurality of operating conditions associated with a pump of a downhole tool configured to be operated in a wellbore of a well. The pump may be coupled to a flowline and a sample bottle for obtaining a sample of a formation fluid. The computer-executable instructions that, when executed, further cause the processor to perform the following: determining, from the plurality of operating conditions, first predictions associated with performance of the pump. The first predictions may include at least one of a minimum alternator voltage, a maximum pump flow rate, a pumpout performance estimate, and an achievable formation mobility. The computer-executable instructions that, when executed, also cause the processor to perform the following: also includes obtaining a type of the formation fluid, one or more wellbore properties associated with the wellbore, and one or more formation properties associated with the formation; and determining based at least in part on the formation fluid type, the one or more wellbore properties, the one or more formation properties, and a pump flow rate at a selected achievable formation mobility, second predictions associated with performance of the pump. The second predictions may include at least one of a volume efficiency of the pump, a minimum pressure in the flowline, a number of strokes of the pump to fill the sampling bottle, and an amount of time to fill the sampling bottle.

Additionally, in some embodiments, a system is provided that includes a processor and a at least one memory storing computer-executable instructions, that when executed, causes the processor to perform the following: obtaining a plurality of operating conditions associated with a pump of a downhole tool configured to be operated in a wellbore of a well. The pump may be coupled to a flowline and a sample bottle for obtaining a sample of a formation fluid. The computer-executable instructions that, when executed, further cause the processor to perform the following: determining, from the plurality of operating conditions, first predictions associated with performance of the pump. The first predictions may include at least one of a minimum alternator voltage, a maximum pump flow rate, a pumpout performance estimate, and an achievable formation mobility. The computer-executable instructions that, when executed, also cause the processor to perform the following: also includes obtaining a type of the formation fluid, one or more wellbore properties associated with the wellbore, and one or more formation properties associated with the formation; and determining based at least in part on the formation fluid type, the one or more wellbore properties, the one or more formation properties, and a pump flow rate at a selected achievable formation mobility, second predictions associated with performance of the pump. The second predictions may include at least one of a volume efficiency of the pump, a minimum pressure in the flowline, a number of strokes of the pump to fill the sampling bottle, and an amount of time to fill the sampling bottle.

BRIEF DESCRIPTION OF THE DRAWINGS

Various embodiments and associated aspects of this disclosure may be better understood upon reading the following detailed description and upon reference to the drawings in which.

DETAILED DESCRIPTION

Figure 1:
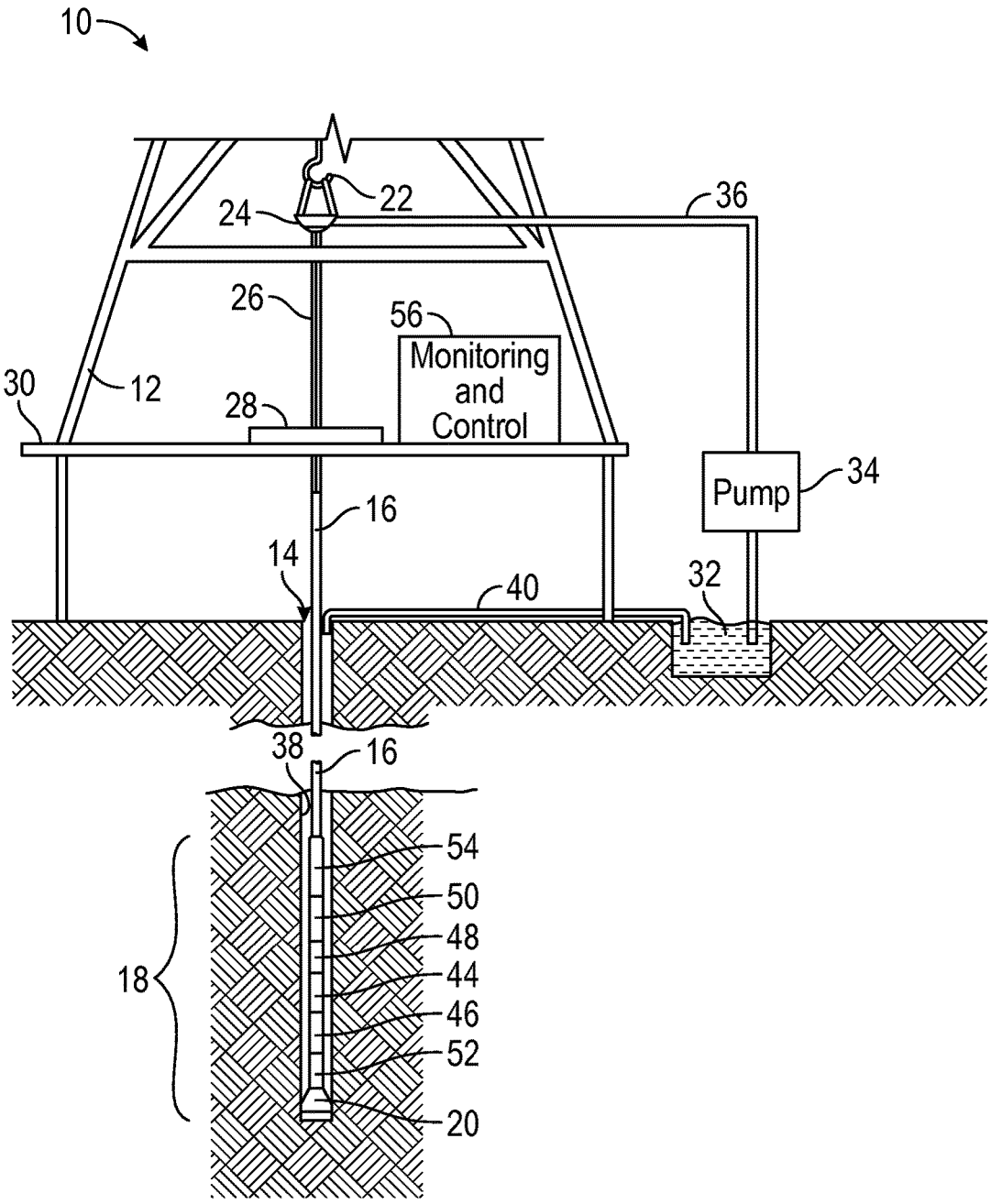
FIG. 1 depicts a drilling system having a downhole tool of a bottomhole assembly (BHA) in accordance with an example embodiment of the present disclosure.

Described herein are various implementations related to a pump performance predictor for a downhole tool. The pump performance predictor may receive inputs and generate outputs that predict the performance of a pump of a pumpout module of a downhole tool. In some embodiments, the operation conditions of a pump operating environment may be provided to the pump performance predictor. In some embodiments, a turbine type and a pump type may also be provided to the pump performance predictor. In some embodiments, the pump performance predictor may calculate and output a set of first predictions that include, for example, the minimum power source (e.g., alternator) voltage of a power module used to power the electronics of the pumpout module, the maximum pump flowrate, the pumpout performance, and the achievable formation mobility.

In some embodiments, a second set of inputs may be provided to the pump performance predictor. The second set of inputs may include, for example, a formation fluid type, wellbore properties, and formation properties. In some embodiments, calculation selections, such as the predictions for a specific operation, may be provided to the pump performance predictor. In some embodiments, the pump performance predictor may calculate and output a set of second predictions that may include, for example, a pump volume efficiency, a pressure profile in a flowline (e.g., including a minimum pressure in the flowline), the number of strokes to fill a sampling bottle, and the time to fill the sampling bottle. In some embodiments, the second predictions may include the number of strokes to purge a flowline and the time to purge flowline before filling the sampling bottle.

In some embodiments, the pump performance predictor may implement various models to enable determination of the predictions from the received inputs. In some embodiments, the pump performance predictor may implement alternator voltage models, a maximum pump speed model, pump rates and differential pressure models, and a formation model. In some embodiments, the pump performance predictor may implement a reservoir pressure drop, flowline pressure drop, and check valve sub-models, a real gas model, and a thermodynamic and transport database of known thermodynamic and transport properties. In some embodiments, the pump performance predictor may include a user interface that provides for user input of some or all of the inputs to the pump performance predictor and displays some or all of the outputs calculated by the pump performance predictor.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail.

More specifically, a drilling system 10 is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 can include a drilling rig 12 positioned over a well 14. Although depicted as an onshore drilling system 10, it is noted that the drilling system could instead be an offshore drilling system. The drilling rig 12 can support a drill string 16 that includes a bottomhole assembly 18 having a drill bit 20. The drilling rig 12 can rotate the drill string 16 (and its drill bit 20) to drill the well 14.

The drill string 16 can be suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 can be coupled to the drill string 16, and the swivel 24 can allow the kelly 26 and the drill string 16 to rotate with respect to the hook 22. In the presently illustrated embodiment, a rotary table 28 on a drill floor 30 of the drilling rig 12 can be constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 can be circulated through the well 14 by a pump 34. The drilling fluid 32 can be pumped from a mud pit (or some other reservoir, such as a mud tank) into the drill string 16 through a supply conduit 36, the swivel 24, and the kelly 26. The drilling fluid 32 can exit near the bottom of the drill string 16 (e.g., at the drill bit 20) and can return to the surface through the annulus 38 between the wellbore and the drill string 16. A return conduit 40 can transmit the returning drilling fluid 32 away from the well 14. In some embodiments, the returning drilling fluid 32 can be cleansed (e.g., via one or more shale shakers, desanders, or desilters) and reused in the well 14. The drilling fluid 32 may include an oil-based mud (OBM) that may include synthetic muds, diesel-based muds, or other suitable muds.

In addition to the drill bit 20, the bottomhole assembly 18 can also include various instruments that measure information of interest within the well 14. For example, as depicted in FIG. 1, the bottomhole assembly 18 can include a downhole drilling and measurement (D&M) tool 44 that may include, for example, a logging-while-drilling (LWD) module, a measurement-while-drilling (MWD) module, or a combination thereof. Both modules can include sensors, housed in drill collars, that can collect data and enable the creation of measurement logs in real-time during a drilling operation. The modules could also include memory devices for storing the measured data. The LWD module can include sensors that measure various characteristics of the rock and formation fluid properties within the well 14. Data collected by the LWD module could include measurements of gamma rays, resistivity, neutron porosity, formation density, sound waves, optical density, and the like. The MWD module can include sensors that measure various characteristics of the bottomhole assembly 18 and the wellbore, such as orientation (azimuth and inclination) of the wellbore, torque, shock and vibration, the weight on the drill bit 20, and downhole temperature and pressure. The data collected by the MWD module 46 can be used to control drilling operations. The bottomhole assembly 18 can also include one or more additional tools and modules 46 and 48, which could be LWD modules, MWD modules, or some other modules. It is noted that the bottomhole assembly 18 is modular, and that the positions and presence of particular modules of the assembly could be changed as desired. The downhole tool 44 may be or may include a fluid sampling tool configured to obtain a sample of a fluid from a subterranean formation and perform downhole fluid analysis to measure various properties of the sampled fluid. These properties may include an estimated density and/or optical density of the OBM filtrate, the sampled fluid, and other fluids. These and other estimated properties may be determined within or communicated to the downhole tool 44, such as for subsequent utilization as input to various control functions and/or data logs.

The bottomhole assembly 18 can also include other modules. As depicted in FIG. 1 by way of example, such other modules can include a turbine generator 50, a steering module 52, and a communication module 54. In one embodiment, the turbine generator 50 can include a generator (such as a turbine) driven by flow of drilling mud through the drill string 16, out of the drill bit 20, and through the annulus 38 to the return conduit 40. The turbine generator 50 may convert the hydraulic power of the drilling fluid 32 moving through the drill string 16 into mechanical rotational power in a rotating shaft. The rotating shaft, which may also include or be referred to as a rotor, provides the mechanical power that will be used to generate electrical power. The rotation of the rotating shaft may cause an alternator to generate electrical power for the components of the bottomhole assembly 18, such as the downhole tool 44.

The steering module 52 may include a rotary-steerable system that facilitates directional drilling of the well 14. The communication module 54 can enable communication of data (e.g., data collected downhole tool 44) between the bottomhole assembly 18 and the surface. In one embodiment, the communication module 54 can communicate via mud pulse telemetry, in which the communication module 54 uses the drilling fluid 32 in the drill string as a propagation medium for a pressure wave encoding the data to be transmitted.

The drilling system 10 can also include a monitoring and control system 56. The monitoring and control system 56 can include one or more computer systems that enable monitoring and control of various components of the drilling system 10. The monitoring and control system 56 can also receive data from the bottomhole assembly 18 (e.g., data from the downhole tool 44 and other modules 46 and 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Figure 2:
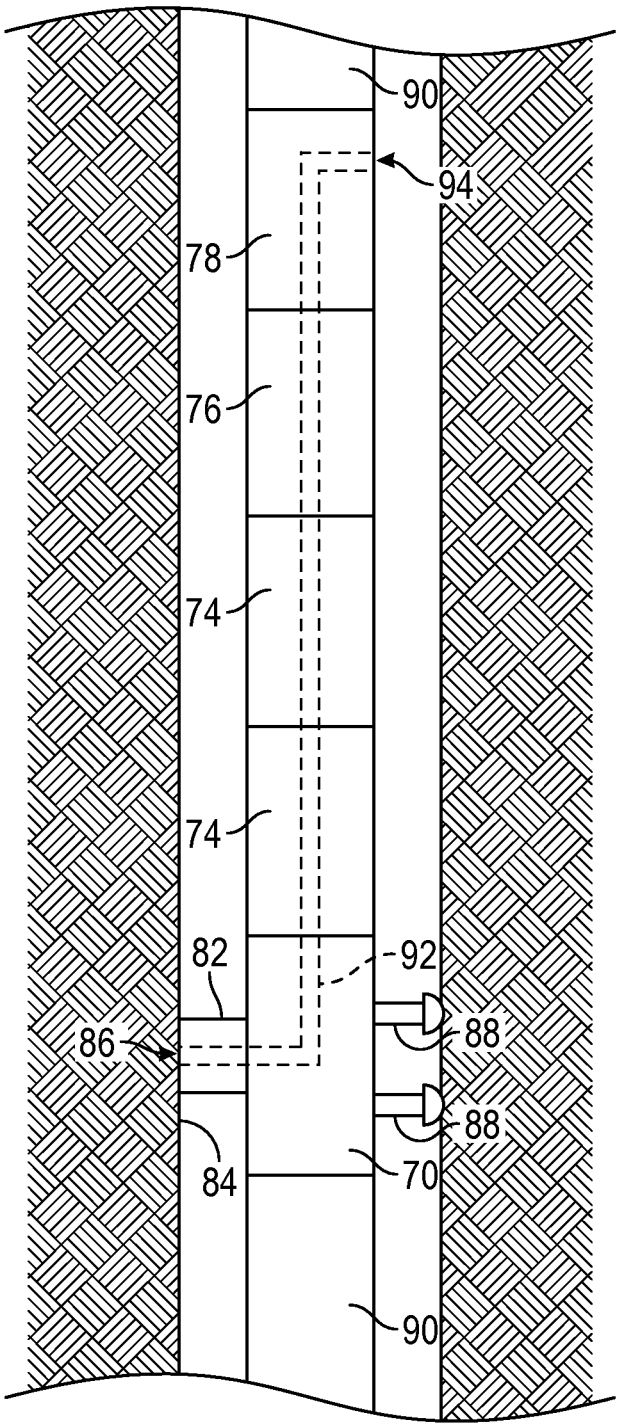
FIG. 2 further depicts a downhole tool of a bottomhole assembly in accordance with an example embodiment of the present disclosure.

FIG. 2 depicts a downhole tool 62 of a bottomhole assembly in further detail. The downhole tool 62 can take various forms. While it is depicted in FIG. 2 as having a body including a probe module 70, a fluid analysis module 72, a pumpout module 74, a power module 76, and a fluid storage module 78, the downhole tool (also known as the fluid sampling tool) 62 may include different modules in other embodiments. The probe module 70 can include a probe 82 that may be extended (e.g., hydraulically driven) and pressed into engagement against a wall 84 of the well 14 to draw fluid from a formation into the fluid sampling tool 62 through an intake 86. As depicted, the probe module 70 can also include one or more setting pistons 88 that may be extended outwardly to engage the wall 84 and push the end face of the probe 82 against another portion of the wall 84. In some embodiments, the probe 82 can include a sealing element or packer that isolates the intake 86 from the rest of the wellbore. In other embodiments, the fluid sampling tool 62 could include one or more inflatable packers that can be extended from the body of the fluid sampling tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the downhole tool 62, such as in the body of a packer module housing an extendable packer.

The pumpout module 74 can draw the sampled formation fluid into the intake 86, through a flowline 92, and then either out into the wellbore through one or more outlets 94 or into a storage container (e.g., a bottle within fluid storage module 78) for transport back to the surface when the fluid sampling tool 62 is removed from the well 14. The fluid analysis module 72, which may also be referred to as the fluid analyzer or a DFA module, can include one or more sensors for measuring properties of the sampled formation fluid, such as the optical density of the fluid, and the power module 76 provides power to electronic and hydraulic components of the fluid sampling tool 62.

The drilling and tool environments depicted in FIGS. 1 and 2 are examples of environments in which a fluid sampling tool may be used to facilitate analysis of a downhole fluid. The presently disclosed techniques, however, could be implemented in other environments as well. For instance, the downhole tool 62 may be deployed in other manners, such as by a wireline, a slickline, coiled tubing, or a pipe string.

Figure 3:
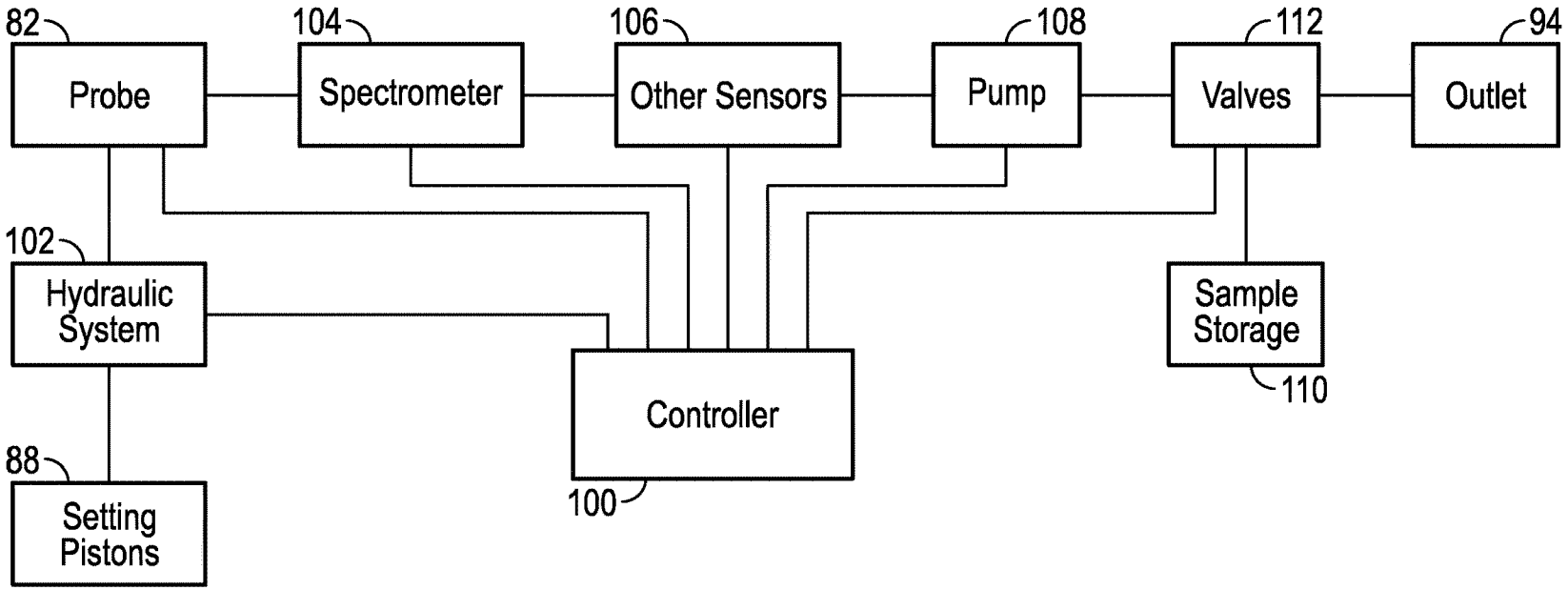
FIG. 3 is a block diagram of components of a downhole tool of a bottomhole assembly in accordance with an example embodiment of the present disclosure.

Additional details as to the construction and operation of the downhole tool 62 may be are illustrated in to FIG. 3. As shown in this figure, various components for carrying out functions of the downhole tool 62 can be connected to a controller 100. The various components can include a hydraulic system 102 connected to the probe 82 and the setting pistons 88, a spectrometer 104 for measuring fluid optical properties, one or more other sensors 106, a pump 108, and valves 112 for diverting sampled fluid into storage devices 110 rather than venting it through one or more outlets 94. For example, the outlets 94 may include an outlet halfway through the flowline (in some embodiments, venting through the flowline may be referred as "dumping"). In some embodiments, the outlets 94 may include an uphole outlet farthest in the flowline. The controller 100 may include or be coupled to an operator interface (not shown) that provides logs of predicted formation fluid properties that are accessible to an operator.

In operation, the hydraulic system 102 can extend the probe 82 and the setting pistons 88 to facilitate sampling of a formation fluid through the wall 84 of the well 14. It also can retract the probe 82 and the setting pistons 88 to facilitate subsequent movement of the downhole tool 62 within the well. The spectrometer 104, which can be positioned within the fluid analyzer 72, can collect data about optical properties of the sampled formation fluid. Such measured optical properties can include optical densities (absorbance) of the sampled formation fluid at different wavelengths of electromagnetic radiation. Using the optical densities, the composition of a sampled fluid (e.g., weight fractions of its constituent components) can be determined. Other sensors 106 can be provided in the downhole tool 62 (e.g., as part of the probe module 70 or the fluid analyzer 72) to take additional measurements related to the sampled fluid. In various embodiments, these additional measurements could include reservoir pressure and temperature, live fluid density, live fluid viscosity, electrical resistivity, saturation pressure, and fluorescence, to name several examples.

In the embodiment depicted in FIG. 3, the controller 100 can facilitate operation of the downhole tool 62 by controlling various components. Specifically, the controller 100 can direct operation (e.g., by sending command signals) of the hydraulic system 102 to extend and retract the probe 82 and the setting pistons 88 and of the pump 108 to draw formation fluid samples into and through the fluid sampling tool. The controller 100 can also receive data from the spectrometer 104 and the other sensors 106. This data can be stored by the controller 100 or communicated to another system (e.g., the monitoring and control system 56 or 66) for analysis. In some embodiments, the controller 100 is itself capable of analyzing the data it receives from the spectrometer 104 and the other sensors 106. The controller 100 can also operate the valves 112 to divert sampled fluids from the flowline 92 into the storage devices 110.

A pump 108 may be provided in the pumpout module 74 to enable formation fluid to be drawn into and pumped through the flowline 92 in the manner discussed above. Sample bottles 110 for formation fluid samples may retain desired samples within the downhole tool 62 and, in some embodiments, transport the formation fluid samples to the surface. Both the storage devices 110 and the check valves 112 may be provided as part of the fluid storage module 78. The pump 108 may be reciprocating pump, such as electromechanical displacement unit (DU) with motor-gearbox-roller-screw. In some embodiments, the valves 112 may include four check valves that may be in line with the flowline 92. As will be appreciated, the piston in the reciprocating pump may move forward and/or in reverse, driven by a motor, in order to create pressure drops and pressure increases that move the formation fluid from the reservoir to sampling bottles of the fluid storage module 78. In some embodiments, four check valves are used in combination to control the flow direction only to the sampling bottles. In some embodiments, the pumpout module 74 may include a turbine alternator, in addition to or instead of a turbine alternator included in the power module.

As described below, the performance of the pump 108 may be predicted using a pump performance predictor that takes various inputs and provided outputs such as pump power and efficiency. The pump performance predictor may provide relatively fast predictions of the pump performance to enable field engineers to relatively quickly plan and estimate operations using the pumpout module, such as sampling, dumping, and filling operations. As described below, the pump performance predictor may be used to calculate relatively accurate pump volume efficiency and other outputs for specific fluid types and downhole operations. Additionally, the pump performance predictor may enable field engineers to estimate the pressure, temperature, and mass flow rate through the pump 108, the number of strokes and time to fill a sampling bottle, the minimum pressure in the flowline to avoid dropping below sample fluid phase change (e.g., saturation pressure) during a sampling job, the number of strokes and time to purge a portion of the flowline (e.g., the portion of the flowline between a halfway outlet and the farthest outlet).

Figure 4:
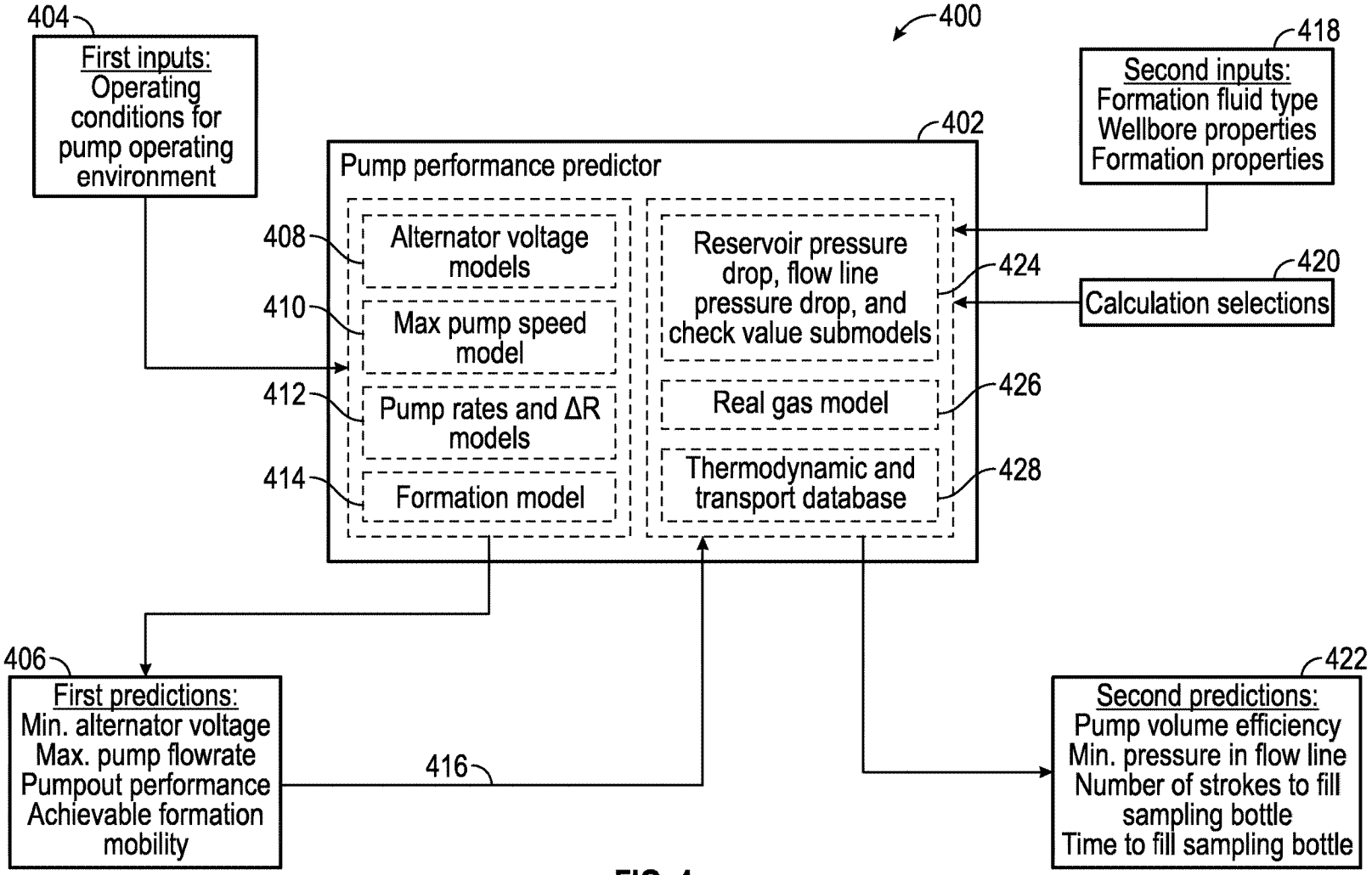
FIG. 4 is a block diagram depicting a flowchart showing the inputs and outputs of a pump performance predictor in accordance with an example embodiment of the present disclosure.

FIG. 4 depicts a flowchart 400 illustrating the inputs and outputs of a pump performance predictor 402 that predicts performance of a pump (e.g., pump 108) of a pumpout module (e.g., pumpout module 74) in accordance with an embodiment of the disclosure. As shown in FIG. 4, in some embodiments, first inputs 404 may include the operating conditions for the pump environment. The operating conditions may include, for example, mud density at the surface (measured in pounds per gallon (ppg), for example), maximum downhole temperature (measured in ° C., for example), maximum downhole pressure (measured in psi, for example), minimum mud flow rate at the lowest downlink (measured in gallons per minute (GPM), for example), formation mobility of interest (measured in millidarcy per centipoise (mD/cP), for example), pressure overbalance ($\Delta p$) above formation pressure (measured in psi, for example), additional ECD pressure due to mud circulation (measured in psi, for example), and sampling drawdown pressure ($\Delta p$) (measured in psi, for example). In some embodiments, the first inputs 404 may be obtained from user input via a graphical user interface, as described below and illustrated in FIG. 14.

Additionally, in some embodiments, the first inputs 404 may include an identification of a turbine type (e.g., a specific turbine manufacturer, model, a turbine operation range, etc.). In some embodiments, the first inputs 404 may include an identification of a pump type (e.g., a specific pump manufacturer, specific pump model, etc.).

Using the first inputs 404, the pump performance predictor 402 may output first predictions 406. In some embodiments, the first predictions 406 may include a minimum power source voltage (measured in volts, for example), e.g., the minimum power source voltage to operate the electronics of the pumpout module at the operation conditions), the turbine rotational speed (measured in RPM, for example) associated with the minimum alternator voltage, a maximum pump flow rate (measured in cc/sec, for example), a pumpout performance (e.g., a graph of maximum DU differential pressure vs. flow rate), an achievable formation mobility (e.g., a graph of achievable mobility vs. flow rate), or any combination thereof. For example, FIG. 14 described below depicts a graph of pumpout performance expressed as maximum DU differential pressure vs. flow rate and a graph of an achievable formation mobility expressed as achievable mobility vs. flow rate. In some embodiments, the graph of an achievable formation mobility may indicate certain areas of interest, such as the lowest attainable mobility at a user defined sampling drawdown pressure, the lowest attainable mobility at a maximum capable drawdown, and the pump flow rate at the mobility of interest attainable at the user defined sampling drawdown pressure.

Figure 5:
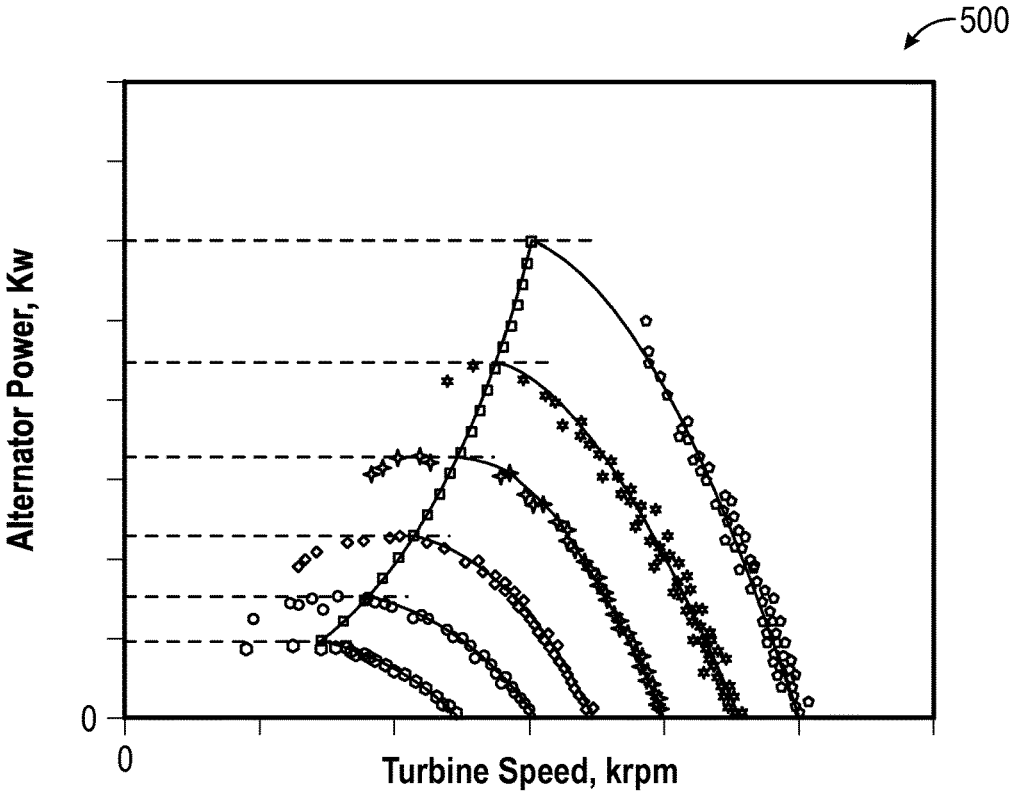
FIG. 5 is a plot of example curve fits for alternator power vs. turbine speed in accordance with an example embodiment of the present disclosure.

In some embodiments, the first predictions 406 may be determined using alternator voltage models 408. The alternator voltage models 408 may include curve fit models based on empirical data that correlates turbine speed to mud flow rate, and turbine speed to alternator voltage. For example, FIG. 5 depicts a plot 500 of example curve fits for alternator power vs. turbine speed at different mud flow rates that may be used to generate the alternator voltage models 408. Based on the first inputs 404, such as the mud flow rates and well conditions of the operating conditions, the pump operation predictor 402 may determine a minimum voltage required to power the pump electronics.

In some embodiments, the first predictions 406 may be determined using a maximum pump speed model 410. The maximum pump speed model 410 may determine a maximum pump speed based at least in part on the on the power source voltage. In some embodiments, the maximum pump speed model 410 be described below in Equation 1:

$$\text{Max_Pump_Speed}=\text{Volt_Alt}*x \quad (1)$$

where x is a scaling factor expressed in RPM/V and is dependent on the pulse width modulation (PWM) drive limitation and impedance drop of the pump system.

Figure 6:
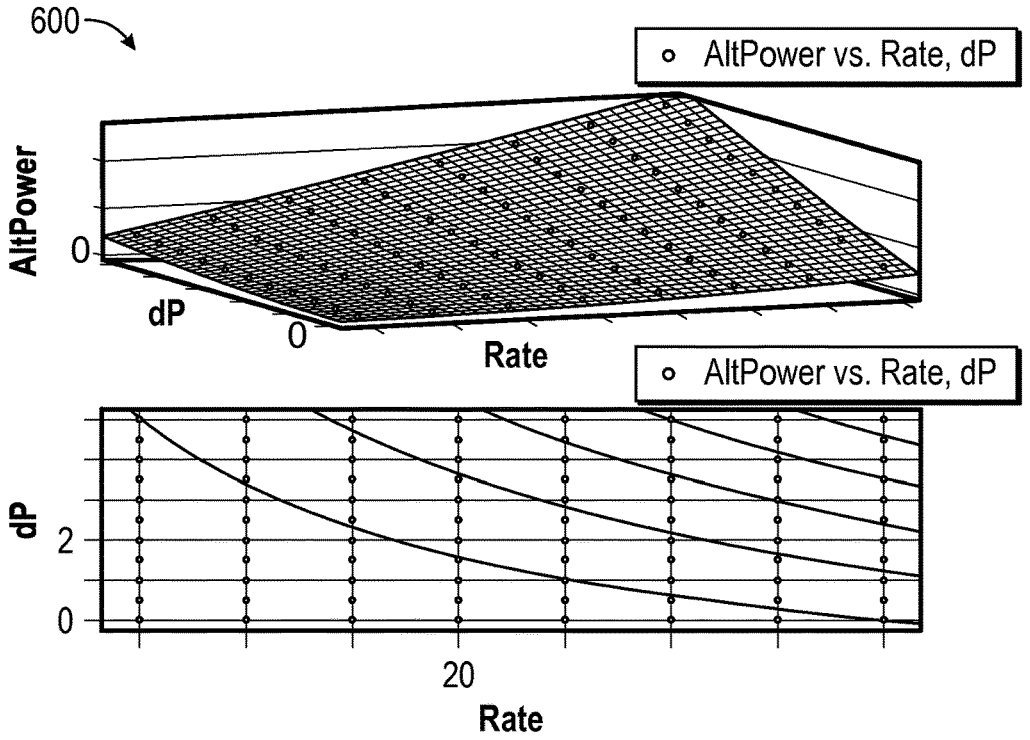
FIG. 6 are plots of two variable curve fits of alternator voltage across a matrix of varying displacement unit (DU) pump rates and DU differential pressures at ambient conditions in accordance with an example embodiment of the present disclosure.

In some embodiments, the pumpout performance of the first predictions 406 may be determined using DU pump rates and DU differential pressure models 412. In some embodiments, the DU pump rates and DU differential pressure models 412 may include a two variable curve fit that fits flow loop empirical data linking the alternator voltage across a matrix of varying DU pump rates and DU differential pressures at ambient conditions. FIG. 6 depicts a two variable curve fit of alternator voltage across a matrix of varying DU pump rates and DU differential pressures at ambient conditions in accordance with an embodiment of the present disclosure. The pump performance predictor may then determine the pumpout performance of the pump as expressed by the achievable DU pump speed and pressure differential capability.

In some embodiments, a formation model 414 may be used to associate the output of the predicted pump at the limited alternator power to the formation response as expressed in pressure drop and mobility. Using the models 408, 410, 412, and 414, the pump performance predictor 404 may model the pump flow rate to the achievable formation response. Additionally, in some embodiments, the models 408, 410, 412, and 414 may be corrected for temperature (and, in some embodiments, other environmental parameters) to further increase the accuracy of the first predictions 406.

In some embodiments, one or more of the first predictions may be input (line 416) into the pump performance predictor 402 and used in the determination of additional predictions. In some embodiments, after the output of first predictions, second inputs 418 may be provided to the pump performance predictor 406. The second inputs 418 may include a formation fluid type, wellbore properties, and formation properties. In some embodiments, the formation fluid type may be selected among a gas, a hydrocarbon mixture, water, or oil. In some embodiments, the composition of a hydrocarbon mixture may be included in the second inputs 418. In some embodiments, the density, compressibility, and viscosity of an oil may be included in the second inputs 418. In some embodiments, calculation selections 420 may also be provided to the pump performance predictor 402. The calculation selections 420 may include a selection of an operation mode (e.g., sampling a formation fluid, dumping a formation fluid, or filling a sampling bottle), a thermal condition (e.g., isentropic (referring to an adiabatic boundary condition, such as no heat transfer through a pumpout module housing) or isothermal (referring to a constant fluid temperature in the pump with assumed infinitely fast heat transfer through the pumpout module housing), and a constant pump rate (measured in cc/sec, for example). In some embodiments, the wellbore properties may include a wellbore pressure (measured in psi, for example). In some embodiments, the formation properties may include formation pressure (measured in psi, for example), formation temperature (measured in ° C., for example), and formation mobility (measured in mD, for example). In some embodiments, the first inputs 404 may be obtained from user input via a graphical user interface, as described below and illustrated in FIG. 15. In some embodiments, additional inputs, calculation selections, or both may be provided to the pump performance predictor 402. For example, the sample bottle volume, DU chamber volume, and other parameters may be provided to the pump performance predictor 402.

Based at least in part on the second inputs 418, the calculation selections 420, and one or more of the first predictions 414, the pump performance predictor 402 may output second predictions 422. In some embodiments, the second predictions 422 may include a pump volume efficiency (expressed as a percentage, for example), the number of strokes to cleanup the flowline and/or fill a sample bottle, the amount of time to cleanup the flowline and/or fill a sampling bottle (measured in sec, for example), and the minimum pressure in the flowline (expressed in psi, for example, and may be used as an indication of phase change during the sampling process). The pump volume efficiency may refer to the effectively used volume during a full pump cycle (e.g., a pump volume efficiency of 53% means that with 1 full stroke (back or forth) fluid of 53% of the chamber volume at the formation state is pumped out). In some embodiments, the prediction of the number of strokes to fill a sample bottle and the amount of time to fill a sampling bottle may be provided in response to calculation selection (e.g., such as when a filling operation is selected).

In some embodiments, the second predictions 422 may be determined using reservoir pressure drop, flowline pressure drop, and check valve sub-models 424, a real gas model 426, and a thermodynamic and transport database 428 (e.g., a database of known thermodynamic and transport properties). For example, the following fourteen (14) paragraphs describe example implementations of the reservoir pressure drop, flowline pressure drop, and check valve sub-models 424, a real gas model 426, and a thermodynamic and transport database 428 in accordance with some embodiments of the pump performance predictor 402.

Figure 7:
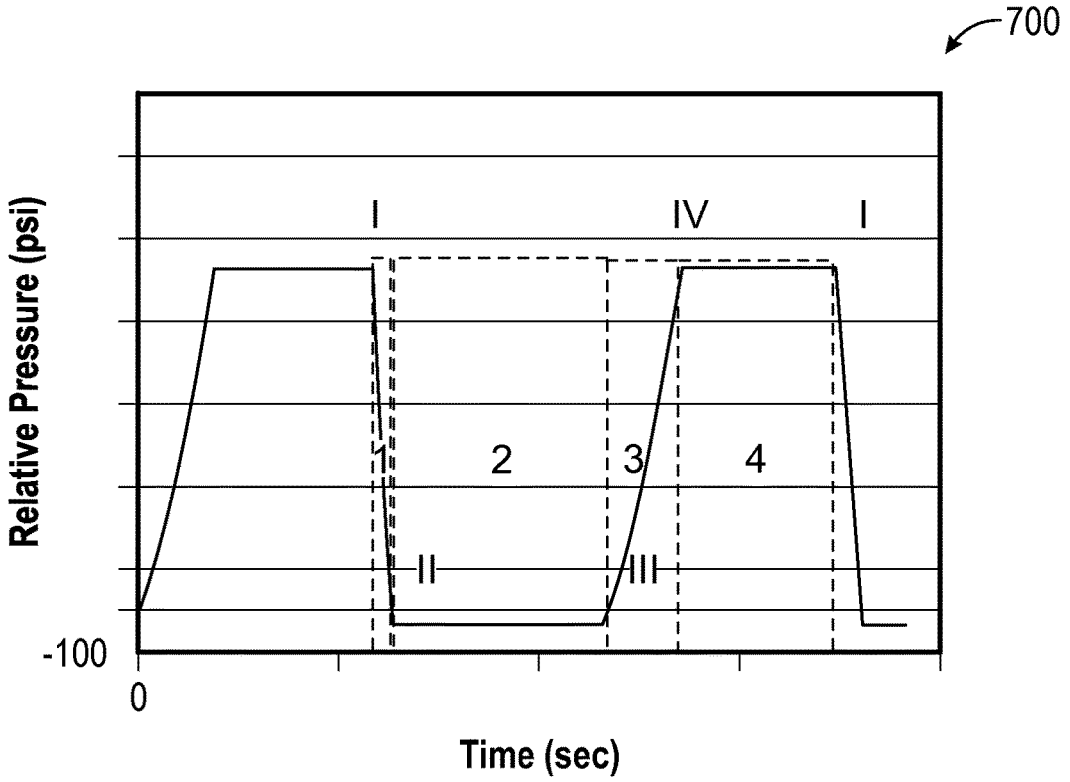
FIG. 7 is a plot of the isentropic processes of fluid samples in a full sampling cycle of a pump in accordance with an example embodiment of the present disclosure.

In some embodiments, the state changes of formation fluid samples in a predicted pump in a full sampling cycle may be modeled as isentropic processes. For example, FIG. 7 depicts a plot 700 of the isentropic processes of fluid samples in a full sampling cycle of a pump modeled as four sub-processes that include, as numbered in FIG. 7: 1) isentropic expansion, closed system; 2) isothermal expansion with mass flow in; 3) isentropic compression for a closed system; and 4) isothermal compression with mass flow out. As also numbered and shown in FIG. 7, four corresponding states may be identified in a full sampling cycle: I) pumpout pressure p1 (where V1=dead volume); II) sample-in pressure p2; III) sample-in pressure p3 (where V3=dead volume plus full stroke volume); and IV) pumpout pressure p4. Given the volumetric flow rate, the pressure of the four sub-processes noted above may be calculated using sub-models 424. Additionally, other properties (e.g., temperature, density, and viscosity) for the sub-processes may be determined using suitable techniques, such as the real gas model 426 and a database 428 having known thermodynamic and transport properties. In some embodiments, the real gas model 426 may be the Peng-Robinson real gas model, although other embodiments may use other models. In some embodiments, the database 428 may be the National Institute of Standards and Technology (NIST) Reference Fluid Thermodynamic and Transport Properties Database available from National Institute of Standards and Technology of Gaithersburg, Md. In other embodiments, the database 428 may include database obtained from other sources.

Figure 8:
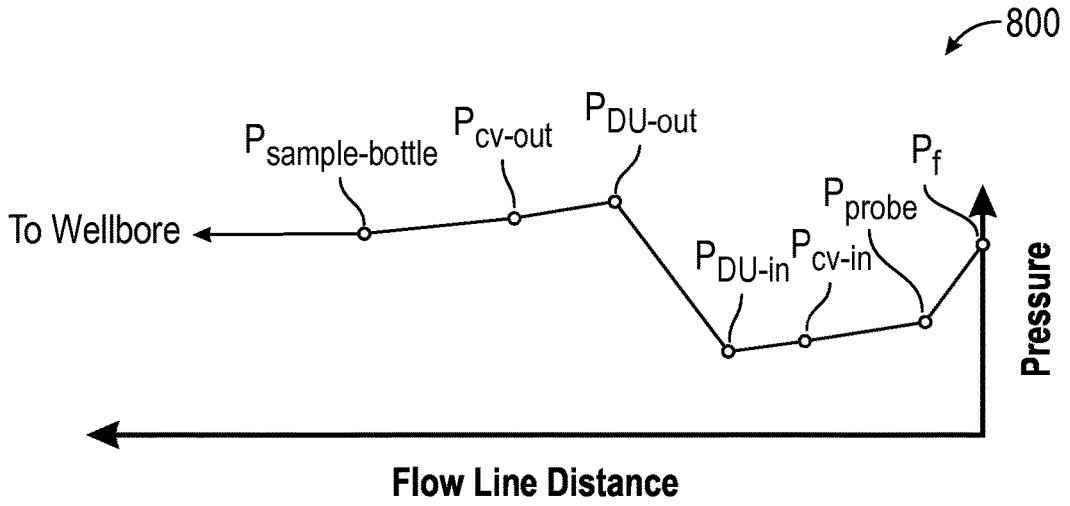
FIG. 8 is a plot of the pressure profile through a sampling flowline of a downhole tool in accordance with an example embodiment of the disclosure.

In view of the foregoing discussion, FIG. 8 depicts the pressure profile 800 through a sampling flowline of a downhole tool in accordance with an example embodiment of the disclosure. The pressure drops from the formation to a probe of the tool may depend on mobility, probe geometry, and flow rate and, as discussed above, head losses may also occurs in the flowline and routing valves (e.g., check valves). For example, as shown in FIG. 8, pressure may be elevated in the pump and may drop downstream of the pump before the fluid enters the sampling bottles.

Figure 9:
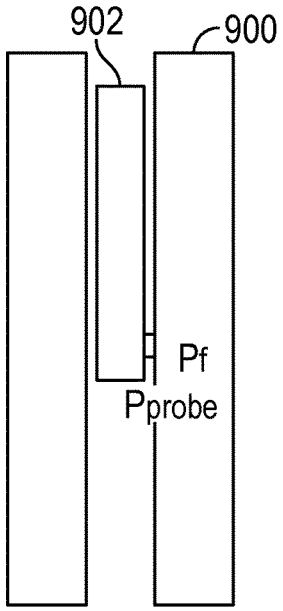
FIG. 9 a schematic diagram of a formation and a downhole tool illustrating the pressure drop in reservoir response during a sampling process in accordance with an example embodiment of the disclosure.

As mentioned above, in some embodiments the pump performance predictor 402 may include a reservoir sub-model. FIG. 9 depicts a schematic diagram of a formation 900 and a downhole tool 902 illustrating the pressure drop in reservoir response (as indicated by probe pressure $p_{probe}$ and formation pressure $p_f$) during the sampling process. In some embodiments, the reservoir model may be a steady-state reservoir model used for both compressible gas and slightly compressible cases, as shown by Equation 2 below:

$$\Delta p = p_f - p_{probe} = \frac{\omega}{4r_{probe}}\frac{\mu}{k}q \tag{2}$$

Where $p_{probe}$ is the pressure at the probe in atm, $p_f$ is the pressure at the formation, ω is a shape factor of the probe, $r_{probe}$ is the probe radius, μ is the viscosity, k is the permeability of the formation, and q is the flow rate.

Figure 10:
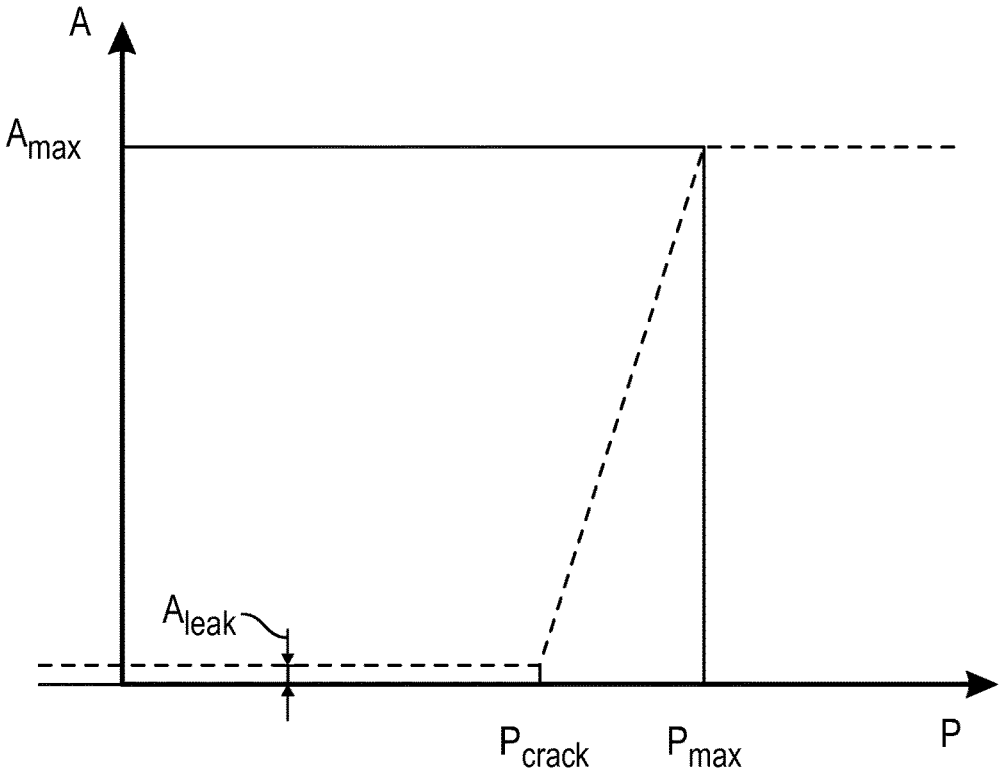
FIG. 10 is a plot of the opening area vs. pressure drops through a check valve of a downhole tool in accordance with an example embodiment of the disclosure.

In some embodiments, the pressure loss in the flowlines may be modeled in the flowline pressure drop sub-model using friction correlations (e.g., the Blasius formula), as shown in Equation 3 below:

$$\Delta p = \frac{1}{2}\rho v^2 f \frac{1}{D} \tag{3}$$

Where p is the pressure, v is the viscosity, D is the diameter of the flowline, and f is determined according to Equation 4 below:

$$f = \begin{cases} \frac{0.316}{Re^{1/4}}, & \text{for turbulent flow with } Re < 10^5 \\ \frac{64}{Re}, & \text{for laminar flow with } Re < 2300 \end{cases} \tag{4}$$

Where Re is the Reynolds number. In some embodiments, the selection of the check valve sub-models may be based on the same routing valves (e.g., check valves) used in the downhole tool. FIG. 10 depicts a plot 1000 of the opening area (A) vs. pressure drops (p) through a check valve of a representative downhole tool in accordance with an example embodiment of the disclosure. As shown in FIG. 10, in some embodiments of the check value models 426 the opening area (A) may be the empirical correlation described below in Equation 5:

$$A(p) = \begin{cases} A_{leak} & \text{for } p \le p_{crack} \\ A_{leak} & \text{for } p_{crack} \le p \le p_{max} \\ A_{max} & \text{for } p \ge p_{max} \end{cases} \tag{5}$$

Similarly, in some embodiments of the check valve models 326 the flow rate (q) may have an empirical correlation described below in Equation 6:

$$q = \begin{cases} C_D A\sqrt{\frac{2}{\rho}|p|}\cdot \text{sign}(p), & \text{for } Re \ge Re_{cr} \\ 2C_{DL}A\frac{D_H}{v\rho}p, & \text{for } Re < Re_{cr} \end{cases} \tag{6}$$

Where $C_D$ is the drag coefficient and k may be determined according to Equation 7:

$$k = \frac{A_{max} - A_{leak}}{p_{max} - p_{crack}} \tag{7}$$

Where p may be determined according to Equation 8:

$$p = p_A - p_B \tag{8}$$

Where the Reynolds number Re may be determined according to Equation 9:

$$Re = \frac{qD_H}{A(p)\cdot v} \tag{9}$$

Where $C_{DL}$ may be determined according to Equation 10:

$$C_{DL} = \left(\frac{C_D}{\sqrt{Re_{cr}}}\right)^2 \tag{10}$$

and Where $D_H$ may be determined according to Equation 11:

$$D_H = \sqrt{\frac{4A(p)}{\pi}} \tag{11}$$

Although the above discussion provides examples of implementations of the Reservoir pressure drop, flowline pressure drop, and check value sub-models 424, the real gas model 426, and the thermodynamic and transport database 428, it should be appreciated that other embodiments may use variations of or different implementations that those presented above.

Figure 11A:
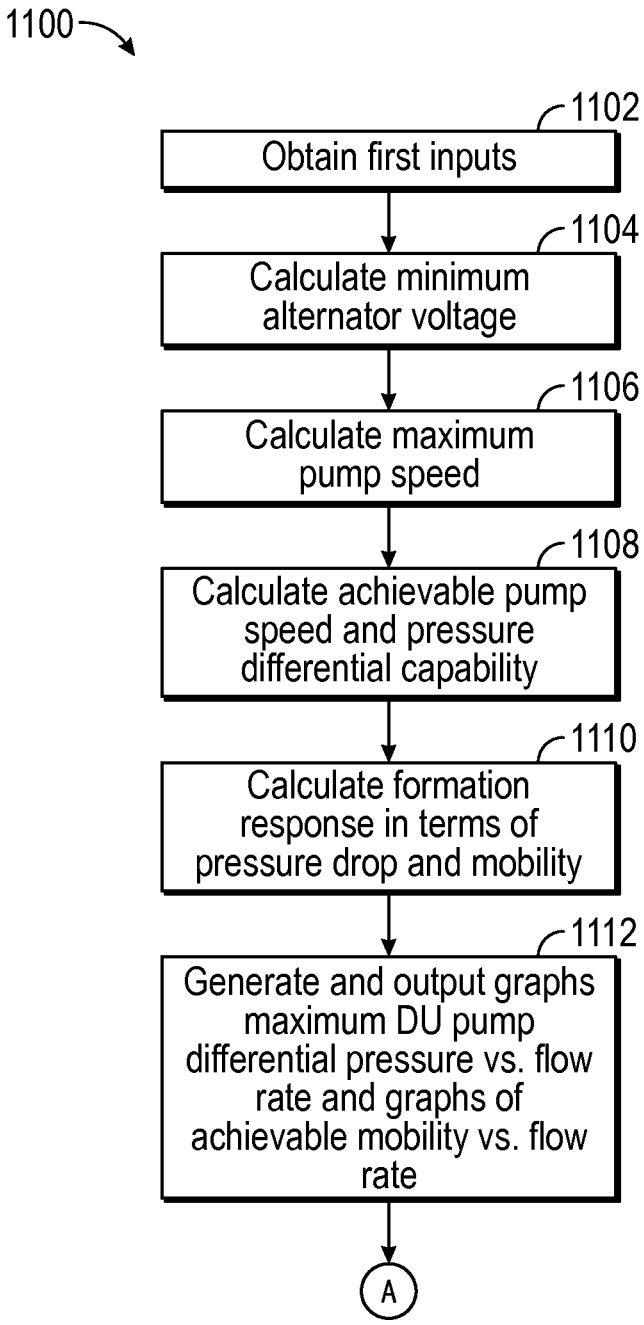
FIGS. 11A and 11B are block diagrams of a process of a pump performance predictor in accordance with an example embodiment of the disclosure.
Figure 11B:
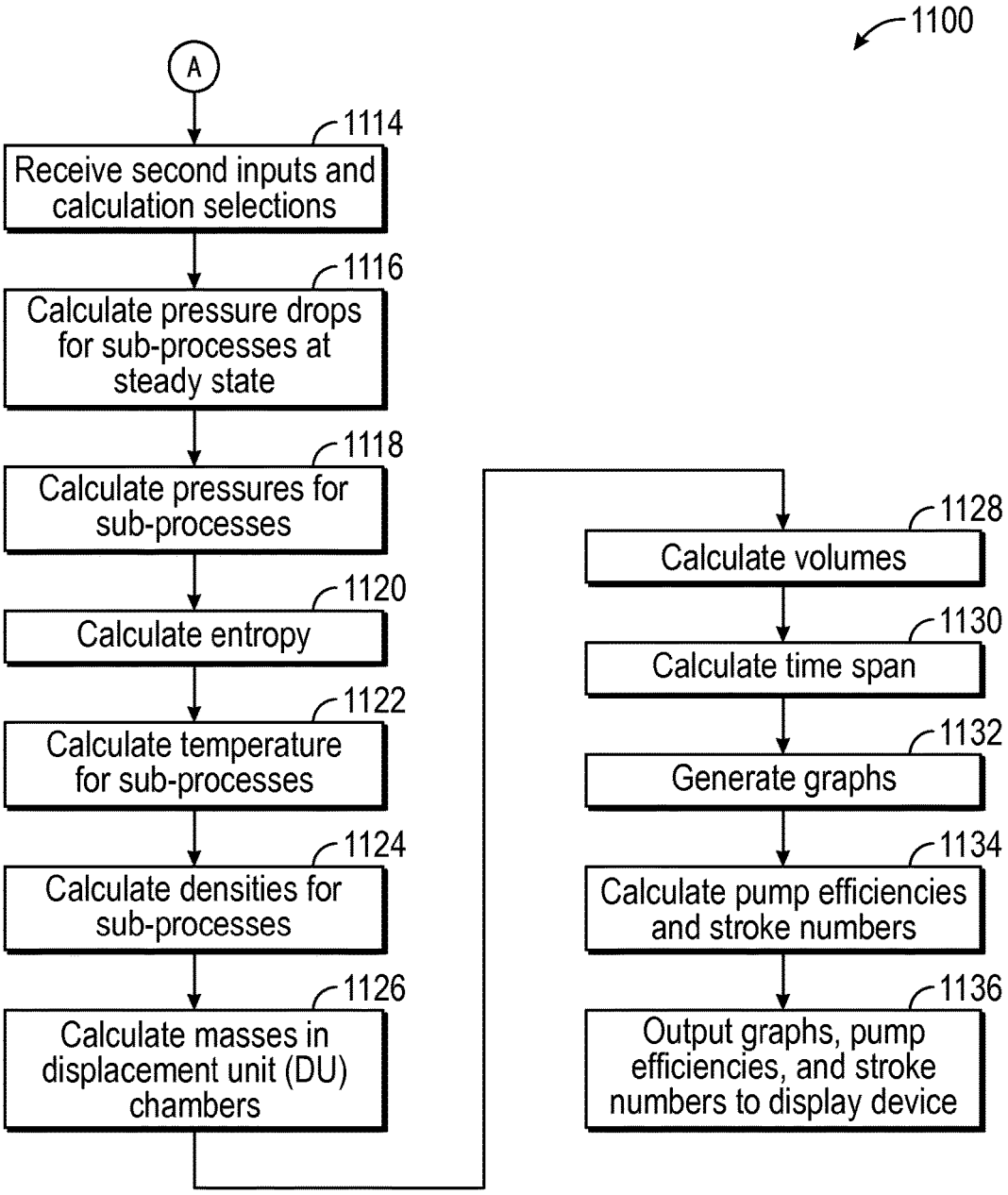

FIGS. 11A and 11B depict a process 1100 of a pump performance predictor 402 (e.g., pump performance predictor 402) in accordance with an example embodiment of the disclosure. Initially, first inputs may be obtained (block 1102), such as from user inputs in a graphical user interface. Next, based at least in part on the mud flow and well conditions obtained in the first inputs, the minimum alternator voltage required to power on the pump electronics may be calculated (block 1104). Based at least in part on the minimum alternator voltage, a maximum pump speed may be calculated (block 1106).

Next, the achievable pump speed and pressure differential capability for the operating conditions of the first inputs may be calculated (block 1108), and the formation response in terms of pressure drop and mobility may be calculated (block 1110). In some embodiments, a graph of maximum DU pump differential pressure vs. flow rate and a graph of achievable mobility vs. flow rate may be generated, and the graphs may be output to a display device (block 1112).

As shown by connector block A, the process 1100 is further illustrated in FIG. 11B. The process 1100 in FIG. 11B depicts determining the second predictions 422 in accordance with an example embodiment of the disclosure. In some embodiments, the calculations described below may be implemented using the reservoir pressure drop, flowline pressure drop, and check valve sub-models 424, the real gas model 426, and the thermodynamic and transport database 428.

Initially, second inputs and calculation preferences may be obtained (block 1114), such as from user inputs into a graphical user interface (GUI) and the outputs from the previous calculations of the process 1100. Next, the pressure drops (Δp1-Δp5) at steady state between each of the sub-processes (p1-p4 described above) may be determined (block 1116), such as from the reservoir pressure drop, flowline pressure drop, and check value sub-models 424. The pressures for each the sub-processes (p1-p4) may then be calculated (block 1118).

Next, the entropy (s) may be calculated (block 1120) using the pressure and temperature of the formation fluid based at least in part on, for example, the real gas model 426 and the thermodynamic and transport database 428. Next, the temperatures (T1-T4) for each of the sub-processes (p1-p4) may be calculated (block 1122) from the pressure and entropy and based at least in part on, for example, the real gas model 426 and the thermodynamic and transport database 428. Next, the densities (ρ1-ρ4) for each of the sub-processes (p1-p4) may be calculated (block 1124) from the pressure and temperate and based at least in part on, for example, the real gas model 426 and the thermodynamic and transport database 428.

Next, as shown in FIG. 11, the masses in each DU chamber (m1-m4) may be calculated (block 1126), and the volumes in each DU chamber (V1-V4) may be calculated (block 1128) from the densities. Next, time spans (t1-t4) may be calculated for each chamber (block 1130). As described herein, graphs may be generated based on the calculated data (block 1132). For example, the graphs may include pressure vs. time, temperature vs. time, and mobility vs. time. As described above, pump efficiencies (η), stroke numbers (N) to fill a sampling bottle, and time to fill a sampling bottle may be calculated (block 1134). In some embodiments, the graphs, pump efficiencies, and stroke numbers may be output to a display device (block 1136).

Figure 12:
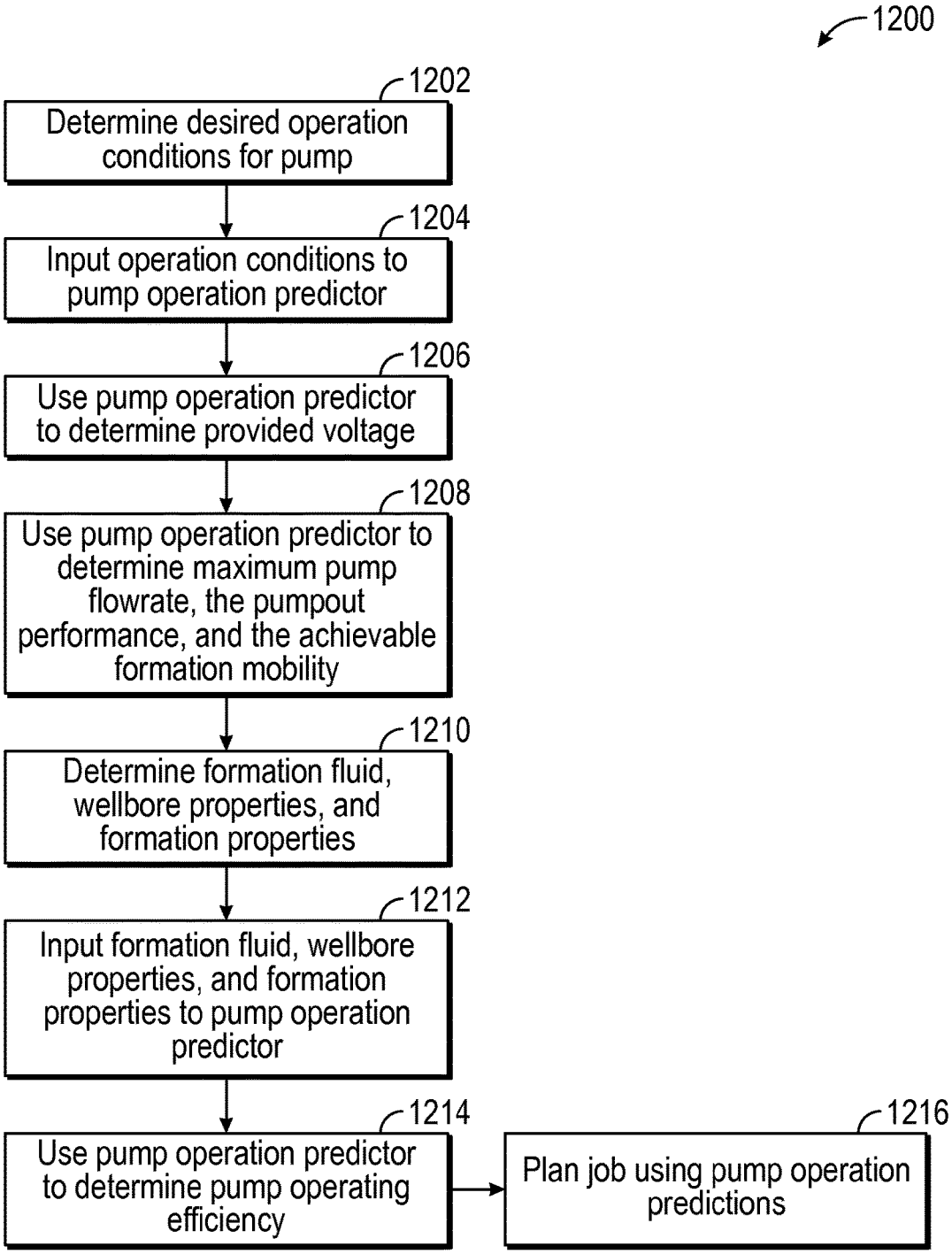
FIG. 12 is a block diagram of a process for using a pump performance predictor in accordance with an example embodiment of the disclosure.

FIG. 12 depicts a process 1200 for using the pump performance predictor 402 in accordance with an example embodiment of the disclosure. Initially, the desired operating conditions for a pump of a pumpout module of a downhole tool may be determined (block 1202). For example, in some embodiments the operating conditions may be from an existing well or, in other embodiments, a well simulation or other sources. Next, the operation conditions may be input to the pump performance predictor (block 1204), such as by using a graphical user interface of the pump operating predictor.

Next, the minimum alternator voltage to operate the pump electronics under the operating conditions may be determined (block 1206). If the alternate voltage is determined to be inadequate, then the operating conditions may be determined to be infeasible and changes may be made to the operating conditions. If the alternator voltage is determined to be adequate, the pump performance predictor may be used to determine the maximum pump flowrate, the pumpout performance, and the achievable formation mobility (block 1208). Next, the formation fluid type, wellbore properties, and formation properties for a well of interest may be determined (block 1210). Here again, in some embodiments the formation fluid type, wellbore properties, and formation properties may be determine from an existing well or, in other embodiments, a well simulation or other sources.

Next, the formation fluid type, wellbore properties, formation properties, and calculation selections, may be input to the pump performance predictor (block 1212), such as using a graphical user interface of the pump performance predictor. Finally, as described above, the pump performance predictor may be used to determine the pump operating efficiency and, in some embodiments, number of strokes and time to fill a sample bottle (block 1214). The pump operating efficiency (and in some instances number of strokes and time to fill a sample bottle) may be used to plan a job using a downhole tool (block 1216). In some embodiments, the pump operating efficiency and other predictions may be used during a job. In some embodiments, the pump operating efficiency and other predictions may be modeled in real-time to evaluate the operation of a downhole tool. For example, a large difference between the actual pump operating efficiency and the model pump operating efficiency may indicate a problem with the downhole tool and prompt corrective action.

Figure 13:
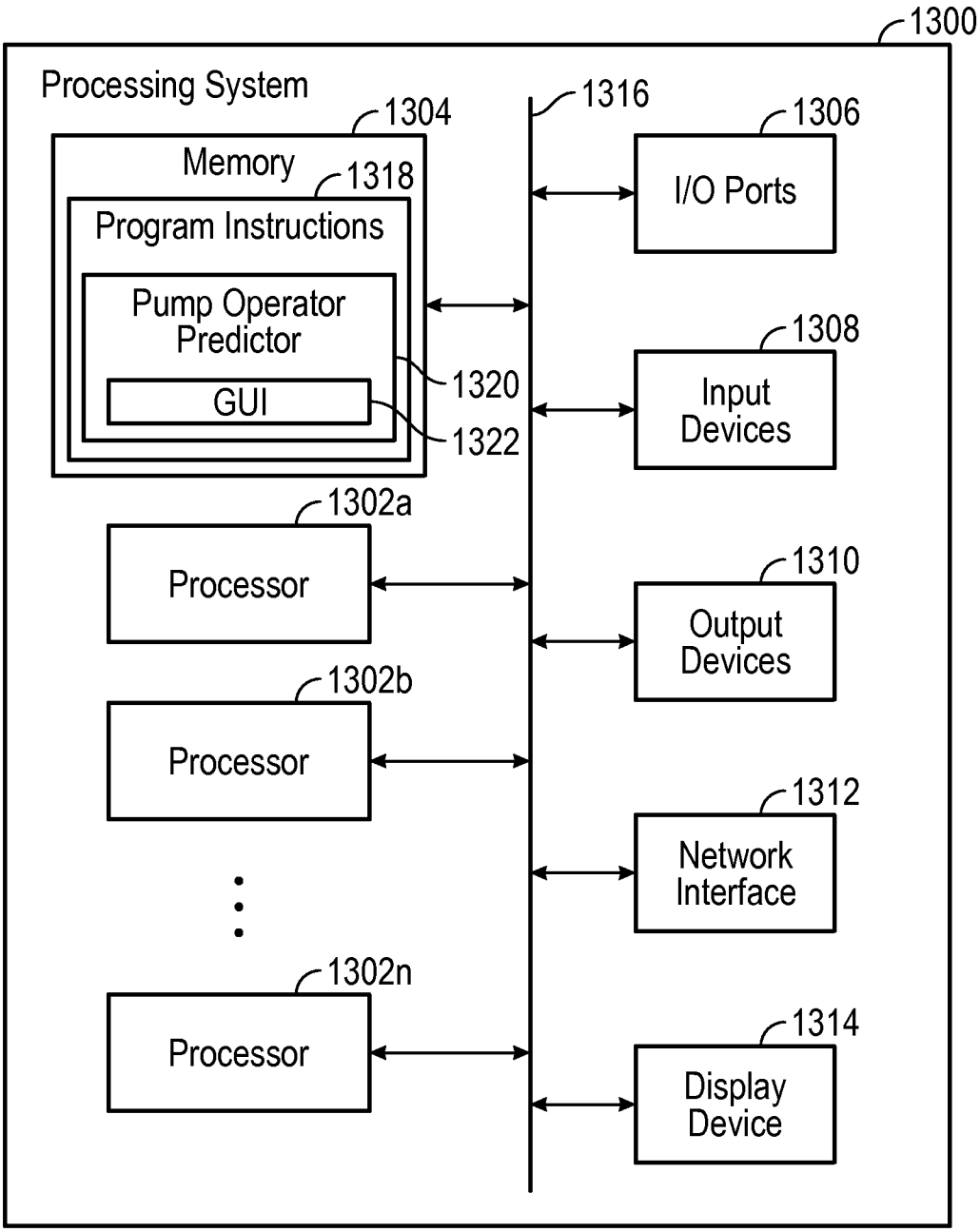
FIG. 13 is a block diagram of a processing system for implementing a pump performance predictor in accordance with an example embodiment of the disclosure.

FIG. 13 is a block diagram of an example processing system 1300 that may execute example machine-readable instructions used to implement one or more of processes described herein and, in some embodiments, to implement a portion of one or more of the example downhole tools described herein. The processing system 1300 may be or include, for example, controllers, special-purpose computing devices, servers, personal computers, personal digital assistant (PDA) devices, tablet computers, wearable computing devices, smartphones, internet appliances, and/or other types of computing devices. In some embodiments, the entirety of the system 1300 shown in FIG. 13 may be implemented within a downhole tool, it is also contemplated that one or more components or functions of the system 1300 may be implemented in wellsite surface equipment. As shown in the embodiment illustrated in FIG. 13, the processing system 1300 may include one or more processors (e.g., processors 1302A-1302N), a memory 1304, I/O ports 1306 input devices 1308, output devices 1310, a network interface 1312, and a display device 1314. The process system 1300 may also include one or more additional interfaces 1314 to facilitate communication between the various components of the system 1300.

The processor 1302 may provide the processing capability to execute programs, user interfaces, and other functions of the system 1300. The processor 1302 may include one or more processors and may include "general-purpose" microprocessors, special purpose microprocessors, such as application-specific integrated circuits (ASICs), or any combination thereof. In some embodiments, the processor 1302 may include one or more reduced instruction set (RISC) processors, such as those implementing the Advanced RISC Machine (ARM) instruction set. Additionally, the processor 1302 may include single-core processors and multicore processors and may include graphics processors, video processors, and related chip sets. Accordingly, the system 1300 may be a uni-processor system having one processor (e.g., processor 1302*a*), or a multi-processor system having two or more suitable processors (e.g., 1302A-1302N). Multiple processors may be employed to provide for parallel or sequential execution of the techniques described herein. Processes, such as logic flows, described herein may be performed by the processor 1302 executing one or more computer programs to perform functions by operating on input data and generating corresponding output. The processor 1302 may receive instructions and data from a memory (e.g., memory 1304).

The memory 1304 (which may include one or more tangible non-transitory computer readable storage mediums) may include volatile memory and non-volatile memory accessible by the processor 1302 and other components of the system 1300. For example, the memory 1304 may include volatile memory, such as random access memory (RAM). The memory 1304 may also include non-volatile memory, such as ROM, flash memory, a hard drive, other suitable optical, magnetic, or solid-state storage mediums or any combination thereof. The memory 1304 may store a variety of information and may be used for a variety of purposes. For example, the memory 1304 may store executable computer code, such as the firmware for the system 1300, an operating system for the system 1300, and any other programs or other executable code for providing functions of the system 1300. Such executable computer code may include program instructions 1318 executable by a processor (e.g., one or more of processors 1302A-1302N) to implement one or more embodiments of the present disclosure. Program instructions 1318 may include computer program instructions for implementing one or more techniques described herein. Thus, in some embodiments, the program instructions 1318 may implement a pump performance predictor 1320 having the capabilities described above. In some embodiments, the pump performance predictor 1320 may include a graphical user interface (GUI) 1322 that may be displayed on the display device 1314.

The interface 1316 may include multiple interfaces and may enable communication between various components of the system 1300, the processor 1302, and the memory 1304. In some embodiments, the interface 1314, the processor 1302, memory 1304, and one or more other components of the system 1300 may be implemented on a single chip, such as a system-on-a-chip (SOC). In other embodiments, these components, their functionalities, or both may be implemented on separate chips. The interface 1316 may enable communication between processors 1302*a*-1302*n*, the memory 1304, the network interface 1312, the display device 1314, or any other devices of the system 1300 or a combination thereof. The interface 1316 may implement any suitable types of interfaces, such as Peripheral Component Interconnect (PCI) interfaces, the Universal Serial Bus (USB) interfaces, Thunderbolt interfaces, Firewire (IEEE-1394) interfaces, and so on.

The system 1300 may also include an input and output port 1308 to enable connection of additional devices, such as I/O devices 1314. Embodiments of the present disclosure may include any number of input and output ports 1308, including headphone and headset jacks, universal serial bus (USB) ports, Firewire (IEEE-1394) ports, Thunderbolt ports, and AC and DC power connectors. Further, the system 1300 may use the input and output ports to connect to and send or receive data with any other device, such as other portable computers, personal computers, printers, etc.

The processing system 1300 may include one or more input devices 1308. The input device(s) 1308 permit a user to enter data and commands used and executed by the processor 1312. The input device 1308 may include, for example, a keyboard, a mouse, a touchscreen, a track-pad, a trackball, an isopoint, and/or a voice recognition system, among others. The processing system 1300 may also include one or more output devices 1310. The output devices 1310 may include, for example, printers, speakers, and other suitable output devices.

The system 1300 depicted in FIG. 13 also includes a network interface 1312. The network interface 1312 may include a wired network interface card (NIC), a wireless (e.g., radio frequency) network interface card, or combination thereof. The network interface 1312 may include known circuitry for receiving and sending signals to and from communications networks, such as an antenna system, an RF transceiver, an amplifier, a tuner, an oscillator, a digital signal processor, a modem, a subscriber identity module (SIM) card, memory, and so forth. The network interface 1312 may communicate with networks (e.g., network 1316), such as the Internet, an intranet, a cellular telephone network, a wide area network (WAN), a local area network (LAN), a metropolitan area network (MAN), or other devices by wired or wireless communication using any suitable communications standard, protocol, or technology.

The system 1300 also includes a display device 1314. The display device 1314 may include may include a liquid crystal display (LCD) an organic light emitting diode (OLED) display, or other display types. In some embodiments, the display 1314 may display a GUI (e.g., GUI 1322) executed by the processor 1302. The display device 1314 may also display various indicators to provide feedback to a user. In some embodiments, the display device 1314 may be a touch screen and may include or be provided in conjunction with touch sensitive elements through which a user may interact with the graphical user interface.

Figure 14:
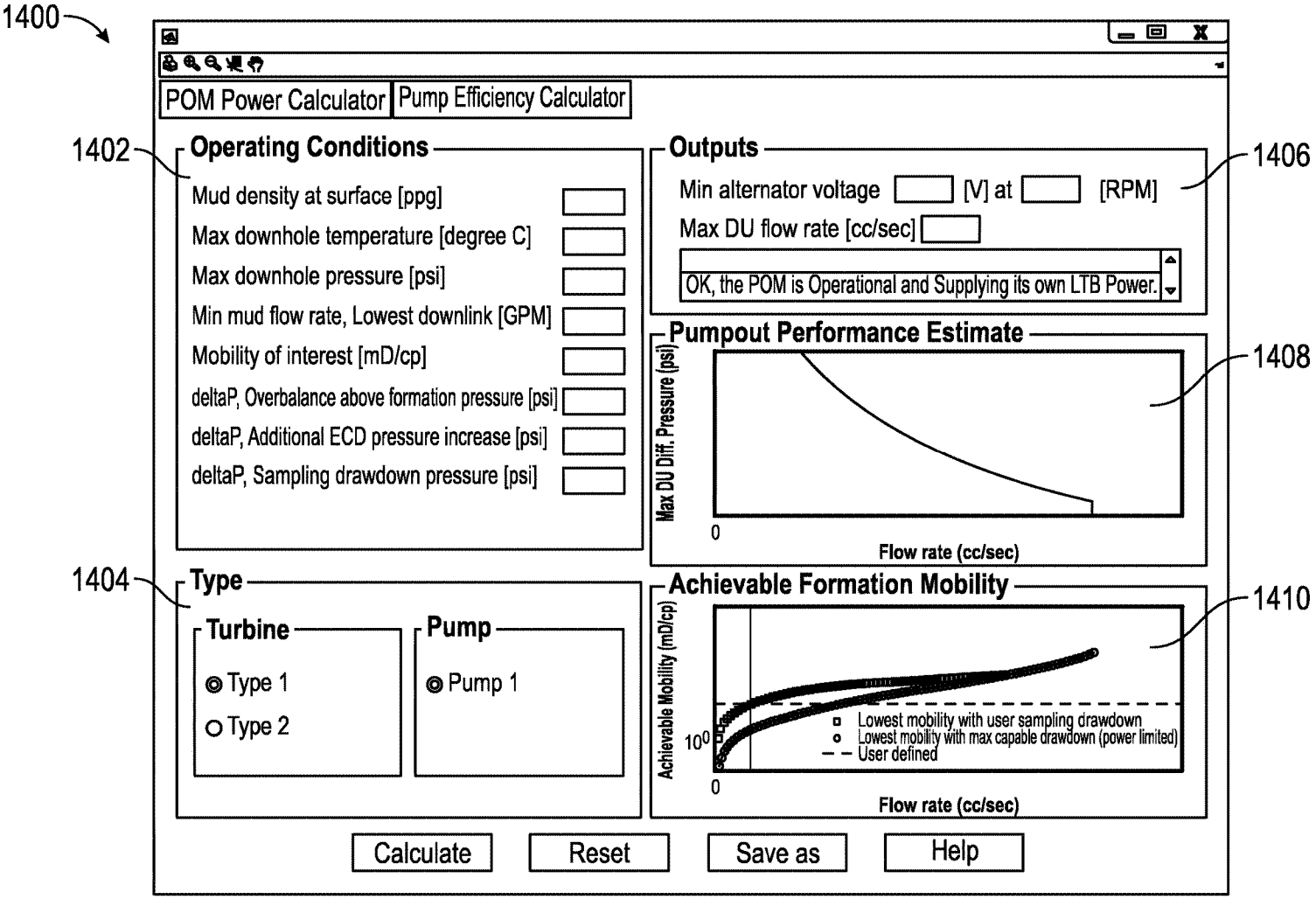
FIGS. 14 and 15 depict diagrams of screens of a user interface of a pump performance predictor in accordance with an example embodiment of the disclosure.
Figure 15:
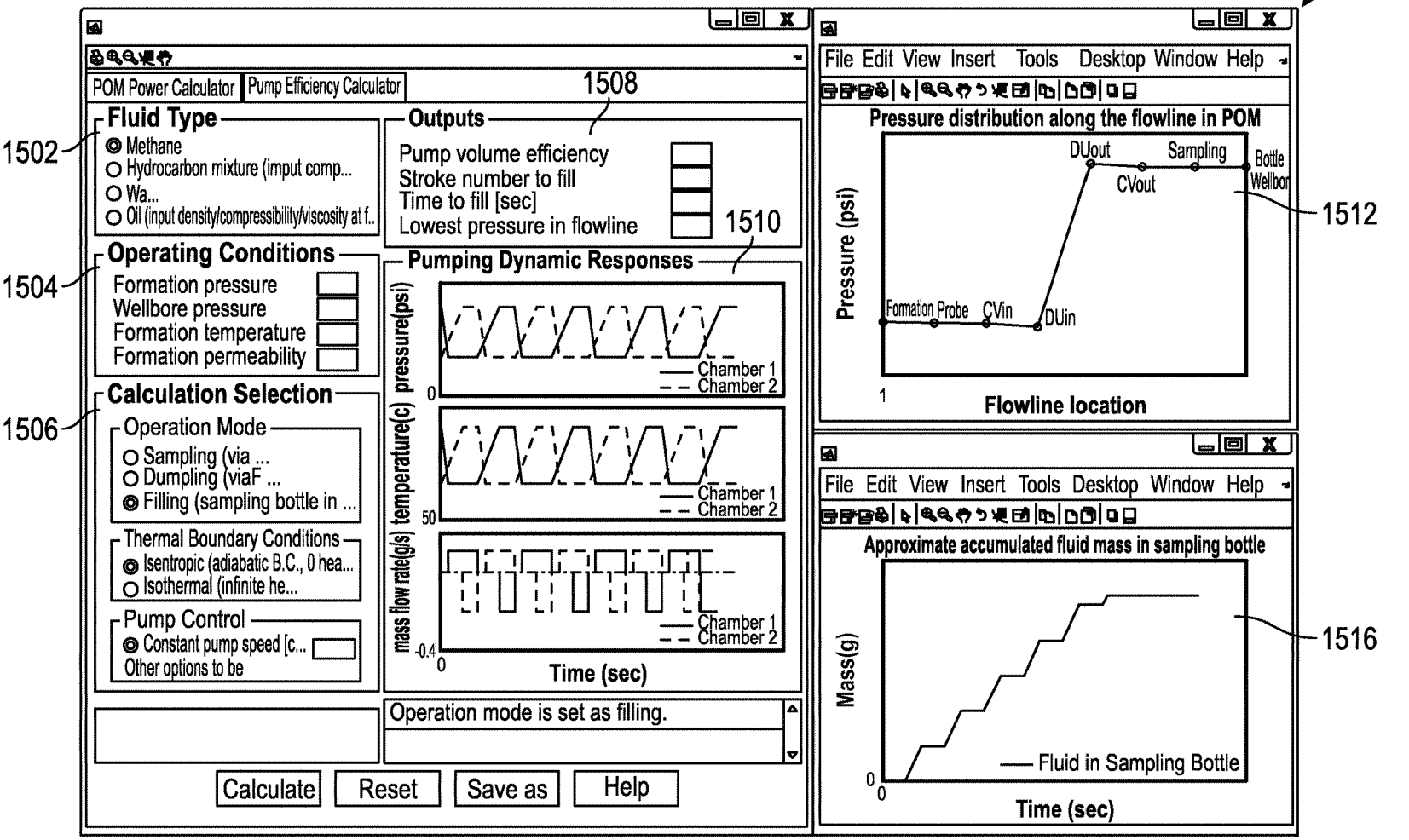

FIGS. 14 and 15 depict example screens of a GUI of the pump performance predictor 402 in accordance with an example embodiment of the invention. In some embodiments, the pump performance predictor may be implemented using MATLAB manufactured by MathWorks of Natick, Mass., USA. In other embodiments, other computing environments may be used to implement the pump performance predictor 402.

FIG. 14 depicts a first example screen 1400 having various user interface elements that enable the user input of inputs to the pump performance predictor and, in some embodiments, the presentation of outputs from the pump performance predictor. In some embodiments, the screen 1400 may include an operating conditions section 1402 that enables the user input of operation conditions of a pump. In some embodiments, the screen 1400 may include a turbine and pump section 1404 that enables the selection of a turbine type and a pump type.

In some embodiments, the screen 1400 includes an outputs section 1406 that displays outputs (e.g., the first predictions described above) of the pump performance predictor. For example, as described above and as shown in FIG. 14, the outputs section 1406 may display a minimum alternator voltage, a maximum DU flow rate, an indication as to whether a pumpout module is powered under the specific operating conditions, and the graphs of pumpout performance and achievable formation mobility described above. As shown in FIG. 14, in some embodiments, the achievable formation mobility graph may indicate the lowest attainable mobility at a user defined sampling drawdown pressure, the lowest attainable mobility at a maximum capable drawdown, and the pump flow rate at the mobility of interest attainable at the user defined sampling drawdown pressure.

FIG. 15 depicts a second screen 1500 of a second example screen 1500 having various user interface elements that further enable the user input of inputs to the pump performance predictor and, in some embodiments, the presentation of outputs from the pump performance predictor. As shown in FIG. 15, the screen 1500 includes various sections that provide for user entry of inputs to the pump performance predictor, including a fluid type section 1502, an operating conditions section 1504, and a section 1506 that provides for user entry of calculation selections.

The screen 1500 also includes additional sections that provide for the display of outputs from the pump performance predictor, such as an outputs section 1508 that displays the pump volume efficiency, the number of strokes to fill a sample bottle, the time to fill a sample bottle, and the lowest pressure in the flowline. In some embodiments, the screen 1500 may include a pumping dynamic responses section 1510 that provides graphs of the pressure, temperature, and mass flow rate for chambers of a pump. In some embodiments, the screen 1500 may include a first FIG. 1512 that illustrates the pressure profile (e.g., including a minimum pressure in the flowline) along the flowline in the pumpout module which, in some embodiments, may be a graph of pressure (expressed in psi, for example) vs. flowline location. In some embodiments, the screen 1514 may include a second FIG. 1516 that illustrates the approximate accumulated fluid mass in a sampling bottle (depending on a selection of operation mode in the calculation selections section 1506) which, in some embodiments, may be a graph of mass (expressed in grams, for example) vs. time (expressed in seconds, for example).

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way used for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense and not for purposes of limitation.

What is claimed is:

1. A method, comprising:

deploying a downhole tool into a wellbore;

obtaining a plurality of operating conditions associated with a pump of the downhole tool configured to be operated in the wellbore of a well, the pump coupled to a flowline and a sample bottle for obtaining a sample of a formation fluid;

determining, from the plurality of operating conditions, predictions associated with performance of the pump, the predictions comprising at least one of a minimum power source voltage, a maximum pump flow rate, a pumpout performance estimate, and an achievable formation mobility; and performing an operation of the downhole tool according to the determined predictions associated with the performance of the pump.

2. The method of claim 1, wherein the predictions comprise first predictions, the method comprising:

obtaining a type of the formation fluid, one or more wellbore properties associated with the wellbore, and one or more formation properties associated with the formation; and determining based at least in part on the formation fluid type, the one or more wellbore properties, the one or more formation properties, and a pump flow rate at a selected achievable formation mobility, second predictions associated with performance of the pump, the second predictions comprising at least one of: a volume efficiency of the pump, a minimum pressure in the flowline, a number of strokes of the pump to fill the sampling bottle, and an amount of time to fill the sampling bottle.

3. The method of claim 2, comprising planning an operation based at least in part on the first predictions and the second predictions.

4. The method of claim 1, wherein the pumpout performance estimate comprises a plot of maximum achievable displacement unit (DU) pressure versus flow rate.

5. The method of claim 1, wherein the achievable formation mobility comprises a plot of maximum achievable formation mobility versus flow rate.

6. The method of claim 1, wherein the plurality of operating conditions comprise at least one of a mud density, a maximum downhole temperature, a maximum downhole pressure, a minimum mud flow rate, a mobility of interest, an overbalance above a formation pressure, an equivalent circulating density (ECD) pressure increase, and a sampling drawdown pressure.

7. The method of claim 2, wherein the formation fluid type comprises a hydrocarbon mixture, water, or oil.

8. The method of claim 2, wherein the one or more wellbore properties comprise a wellbore pressure.

9. The method of claim 2, wherein the one or more formation properties comprise at least one of a formation pressure, a formation temperature and a formation permeability.

10. The method of claim 2, comprising obtaining a thermal condition and wherein determining, from the one or more wellbore properties, the one or more formation properties, and one or more of the first predictions, second predictions associated with a sampling operation comprising determining the second predictions for the obtained thermal condition.

11. The method of claim 2, wherein obtaining a formation fluid type comprises obtaining one or more fluid properties or one or more fluid compositions.

12. The method of claim 3, wherein the operation comprises a filling of the sampling bottle.

13. A non-transitory machine-readable medium storing computer-executable instructions that, when executed, causes a processor to perform the following:

obtaining a plurality of operating conditions associated with a pump of a downhole tool configured to be operated in a wellbore of a well, the pump coupled to a flowline and a sample bottle for obtaining a sample of a formation fluid;

determining, from the plurality of operating conditions, first predictions associated with performance of the pump, the first predictions comprising a minimum power source voltage; a maximum pump flow rate, a pumpout performance estimate, and an achievable formation mobility; and performing an operation of the downhole tool according to the determined predictions associated with the performance of the pump.

14. The non-transitory machine-readable medium of claim 13, the computer-executable instructions that, when executed, further cause a processor to perform the following:

obtaining a type of the formation fluid, one or more wellbore properties associated with the wellbore, and one or more formation properties associated with the formation; and determining based at least in part on the formation fluid type, the one or more wellbore properties, the one or more formation properties, and a pump flow rate at a selected achievable mobility, second predictions associated performance of the pump, the second predictions comprising at least one of: a volume efficiency of the pump, and a minimum pressure in the flowline.

15. The non-transitory machine-readable medium of claim 14, the second predictions comprising at least one of: an amount of time to purge a flowline and a number of strokes of the pump to purge the flowline the sampling bottle.

16. The non-transitory machine-readable medium of claim 13, wherein the pumpout performance estimate comprises a plot of maximum achievable displacement unit (DU) pressure versus flow rate.

17. The non-transitory machine-readable medium of claim 13, wherein the achievable formation mobility comprises a plot of maximum achievable formation mobility versus flow rate.

18. The non-transitory machine-readable medium of claim 13, wherein the plurality of operating conditions comprise at least one of a mud density, a maximum downhole temperature, a maximum downhole pressure, a minimum mud flow rate, a mobility of interest, an overbalance above a formation pressure, an equivalent circulating density (ECD) pressure increase, and a sampling drawdown pressure.

19. The non-transitory machine-readable medium of claim 14, wherein the formation fluid type comprises a hydrocarbon mixture, water, or oil.

20. A system, comprising:

a processor;

at least one memory storing computer-executable instructions, that when executed, causes the processor to perform the following:

obtaining a plurality of operating conditions associated with a pump a downhole tool configured to be operated in a wellbore of a well, the pump coupled to a flowline and a sample bottle for obtaining a sample of a formation fluid;

determining, from the plurality of operating conditions, first predictions associated with performance of the pump;

obtaining a type of the formation fluid, one or more wellbore properties associated with the wellbore, and one or more formation properties associated with the formation;

determining, based at least in part on the formation fluid type, the one or more wellbore properties, the one or more formation properties, and a pump flow rate at a selected achievable mobility, second predictions associated with performance of the pump, the second predictions comprising a volume efficiency of the pump; and performing an operation of the downhole tool according to the determined predictions associated with the performance of the pump.

21. The system of claim 20, wherein the first predictions comprise a minimum alternator voltage; a maximum pump flow rate, a pumpout performance estimate, and an achievable formation mobility.

22. The system of claim 20, wherein the second predictions comprise a minimum pressure in the flowline, a number of strokes of the pump to fill the sampling bottle, and an amount of time to fill the sampling bottle.

* * * * *